United States Patent [19]

Cueto

[11] Patent Number: 4,898,290

[45] Date of Patent: Feb. 6, 1990

[54] CONVERTIBLE BABY FEEDING BOTTLE

[76] Inventor: Prudente G. Cueto, 13617 Paseo Cardiel, San Diego, Calif. 92129

[21] Appl. No.: 216,510

[22] Filed: Jul. 11, 1988

[51] Int. Cl.[4] ..... A61J 9/00; A61J 11/04

[52] U.S. Cl. ..... 215/11.1; 215/1 A

[58] Field of Search ..... 215/11.1–11.6

[56] References Cited

U.S. PATENT DOCUMENTS

| | | | |
|---|---|---|---|
| Re. 6,809 | 12/1875 | Burr . | |
| 159,197 | 1/1875 | Mason | 215/11.1 |
| 224,557 | 2/1880 | Potter . | |
| 227,075 | 4/1880 | Thompson | 215/11.1 |
| 234,224 | 11/1880 | Barton . | |
| 253,014 | 1/1882 | Day | 215/11.1 |
| 275,288 | 4/1883 | Thomas | 215/11.1 |
| 279,935 | 6/1883 | Glattsteine | 215/11.1 X |
| 280,656 | 7/1883 | Morris | 215/11.1 |
| 593,830 | 11/1897 | Borgenschild . | |
| 2,760,664 | 8/1956 | D'Amico et al. | 215/11.1 |
| 3,071,272 | 1/1963 | Doner | 215/11.1 |
| 4,301,934 | 11/1981 | Forestal | 215/11.4 |
| 4,463,859 | 8/1981 | Greene | 215/11.1 |

FOREIGN PATENT DOCUMENTS

| | | | |
|---|---|---|---|
| 208564 | 3/1909 | Fed. Rep. of Germany | 215/11.1 |
| 4999 | of 1882 | United Kingdom | 215/11.1 |
| 725887 | 3/1955 | United Kingdom | 215/11.1 |
| 2067416 | 7/1981 | United Kingdom | 215/11.4 |

*Primary Examiner*—Sue A. Weaver

*Attorney, Agent, or Firm*—Brown, Martin, Haller & McClain

[57] ABSTRACT

A convertible baby feeding bottle having an extension comprising a cap releasably mounted on an open end of the bottle, a fluid conveying tube extending from the interior of the bottle, through the cap, to a position spaced from the bottle, and a nipple assembly releasably mounted on the free end of the tube. The nipple assembly comprises an adapter member having a connector for securing to the tube, a nipple, and a retainer ring for selectively securing the nipple either to the adapter member or directly to the bottle when the extension is not used.

15 Claims, 1 Drawing Sheet

CONVERTIBLE BABY FEEDING BOTTLE

BACKGROUND OF THE INVENTION

The present invention relates generally to baby feeding or nursing bottles, and more specifically to bottles having a flexible tube extending from the bottle to the nipple, to allow the bottle to be placed or secured in a stable position while the baby is nursing.

Baby feeding bottles generally consist of a bottle having an open end with a suitable nipple mounted on the open end of the bottle via a retainer ring or the like. One problem with this arrangement is that when babies are unable to hold the bottle themselves, and parents or other care givers are unable to do so, for example while travelling, there is no effective way to feed the baby. Also, even babies capable of holding bottles are liable to drop them or turn them upside down, potentially spilling the contents.

Nursing bottles have been proposed in the past in which a flexible suction tube extends from the bottle and has a nipple assembly secured at its free end. This allows the bottle to be secured at a remote location while the baby is feeding. In U.S. Pat. No. 2,760,664 of D'Amico, for example, a bottle is secured to the side of a crib or other support, and a flexible fluid conducting tube extends from the lower end of the bottle with a nipple provided at the terminal end of the tube. U.S. Pat. Nos. 253,014 of Day, 275,288 of Thomas, 224,557 of Potter, 279,935 of Glattsteine, 227,075 of Thompson, 159,197 of Mason, and Re-Issued Pat. No. 6,809 of Burr, show various nursing bottles in which a nipple is secured to the bottle via a flexible fluid conducting tube.

SUMMARY OF THE INVENTION

It is an object of this invention to provide an improved baby feeding bottle.

According to the present invention, a baby feeding bottle is provided which comprises a bottle having an open end, a cap releasably mountable on the open end of the bottle, the cap having an opening, a tubular fluid conducting assembly extending from the interior of the bottle through the cap opening for conveying fluid outside the bottle, at least the portion of the assembly outside the bottle comprising a flexible tube, and a nipple assembly mounted on the free end of the flexible tube. The nipple assembly comprises an adapter member having a connector for securing the adapter member to the end of the tube, a nipple, and a retainer ring for selectively securing the nipple to the adapter member or directly to the open end of the bottle. The adapter member has a through bore connecting the tube to the nipple.

This arrangement allows the nipple to be mounted directly on the bottle for standard feeding, omitting the cap and tubular assembly, or mounted on the end of the tube via the adapter to provide an extension in situations where the bottle cannot be held. Preferably, the adapter member is designed to mate with standard nipple retainer rings, while the cap is designed to fit on the open end of a standard baby bottle, so that the arrangement can be utilized with existing baby bottles. In the preferred arrangement, the adapter member has an outer diameter equal to that of the neck at the open end of a baby bottle, and the neck and adapter member each have interengaging formations such as external screw threads for selectively mating with corresponding formations such as internal screw threads on the cap and retainer ring.

Standard nipples typically have pin holes around the flange of the nipple to allow air to enter the bottle. The adapter member is provided with a suitable shield for covering these openings when the nipple is attached to the end of the flexible tube, since otherwise suction of liquid out of the bottle via the tube may be impeded. Finger grips may be provided to allow the adapter to be unscrewed easily from the retainer ring to release the nipple for cleaning or replacement, or for attachment directly to a bottle.

This arrangement allows the bottle to be used either directly with the nipple mounted on the open end of the bottle, or remotely with the same nipple mounted at the free end of the flexible tube. The arrangement can be used with existing standard baby bottles. The adapter member and cap may be provided in different sizes and with different interengaging formations corresponding to different types of baby bottles.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
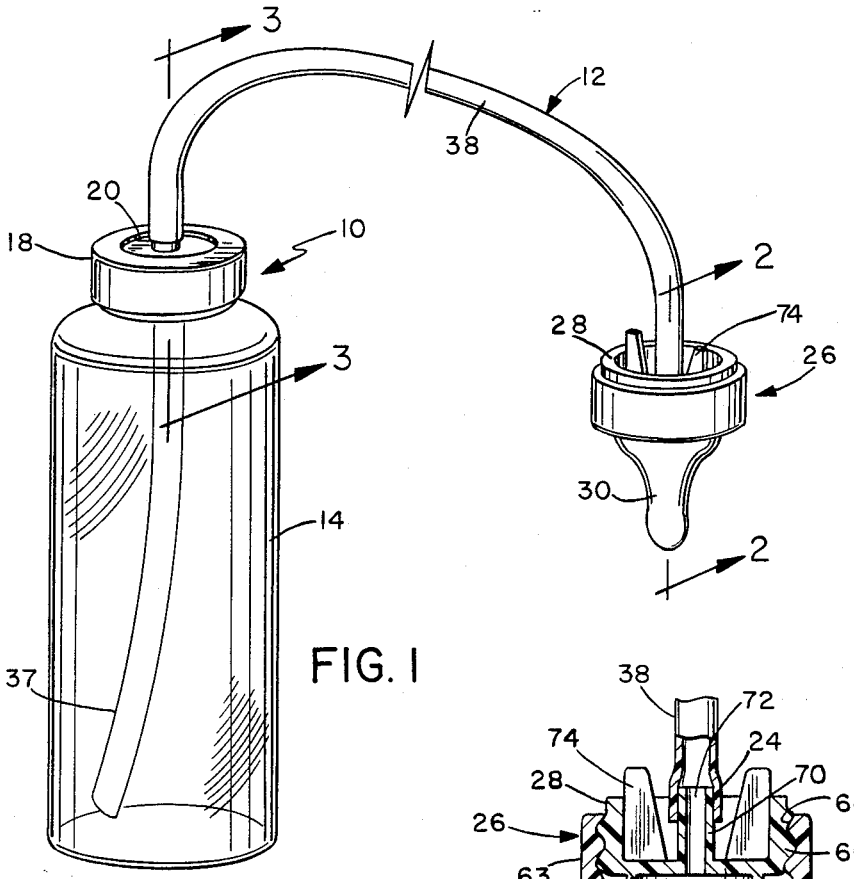
FIG. 1 is a perspective view of a baby feeding bottle with an extension according to a preferred embodiment of the present invention.

The drawings illustrate a baby feeding arrangement or bottle assembly 10 having an extension 12 according to a preferred embodiment of the present invention. The assembly comprises a bottle 14, which is normally of transparent glass or plastic material, having an open upper end or neck portion 16 closed by a cap member 18 having a central opening 20. A tubular fluid conveying tube 22 extends from the interior of the bottle, through the opening in the cap member 18, and away from the bottle. The free external end 24 of the tube is secured to a nipple assembly 26 consisting of an adapter member 28 on which the end 24 is mounted and a nipple 30 secured to the adapter member via a retainer ring 32.

Figure 3:
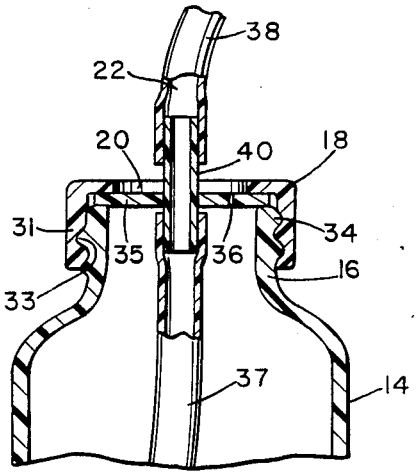
FIG. 3 is an enlarged sectional view taken on line 3—3 of FIG. 1.

As illustrated in FIG. 3, the cap member 18 is of cup-like shape, having a depending skirt portion 31 with internal screw threads 33. Internal screw threads 33 engage corresponding external screw threads 34 on neck portion 16 of the bottle. A suitable anti-leak gasket 35 may be trapped between the cap and the open upper end of the bottle. Gasket 35 may have one or more pin holes 36, as indicated, for allowing air to enter the bottle.

Figure 4:
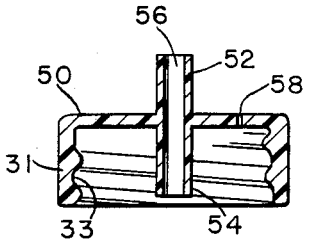
FIG. 4 is similar to a portion of FIG. 3 illustrating an optional one-piece cap.

The tube 22 in the preferred embodiment shown consists of two parts, a first part 37 which extends from the inner side of the cap member to the interior of the bottle, and a second, flexible part 38 which extends from the outer side of the cap member outside the bottle. In the version illustrated in FIG. 3, a rigid tubular connecting piece 40 extends through the cap opening and an aligned opening in the gasket 35 for connection to the respective ends of the parts 37 and 38 of the tube, which fit closely over the opposite ends of connecting piece 40. FIG. 4 illustrates a modified cap member 50, which itself has tubular projections 52 and 54 from its inner and outer faces connected via through bore 56. In this version, the ends of the respective parts of the tube can be connected to the cap projections 52 and 54 directly. This provides a more fluid-tight connection. Cap 50 may also be provided with pin holes 58, as illustrated. The cap 50 is otherwise identical to cap 18, and equivalent reference numerals have been used where appropriate. In another modification, the fluid conveying tube could be in one piece extending through the cap, with a suitable leak resistant seal arrangement.

Figure 2:
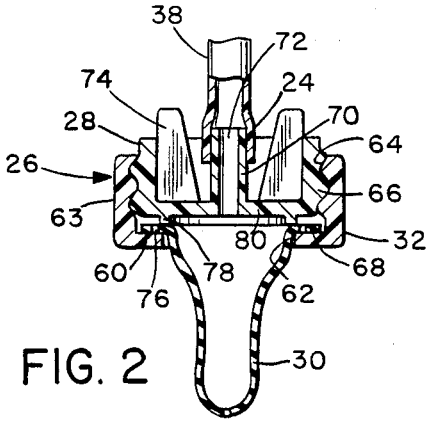
FIG. 2 is an enlarged sectional view taken on line 2—2 of FIG. 1.

The nipple assembly is illustrated in more detail in FIG. 2. The nipple 30 and retainer ring 32 are preferably of a standard type, which can alternatively be mounted directly on the neck of the bottle when no extension is needed. The retainer ring 32 is identical to cap member 18 and is of cup-like shape with an annular flange or end face 60 having central opening 62 through which the nipple projects, and a skirt 63 depending from portion 60 having internal screw threads 64 equivalent to the internal threads on cap member 18 for selectively securing to the external screw threads on the bottle itself. The adapter member 28 is designed to fit into the retainer ring 32, as illustrated in FIG. 2, and is a cup-like member having external screw threads 66 for engagement with the internal screw threads on retainer ring 32 with the rim or flange 68 of the nipple trapped between opposing faces of the adapter member and retainer ring. The retainer ring fits over the neck of the bottle or the adapter member 28, depending on whether or not the extension is to be used. Thus, the adapter member is designed to have identical external dimensions to the neck of the bottle. Member 28 has a central connector tube or spigot 70 projecting from its inner face over which the free end of the tube 38 can be mounted, as illustrated in FIG. 2. The adapter member spigot 70 has a bore 72, which connects tube 38 to the nipple 30. The adapter member 28 is also provided with finger grips 74, which project outwardly from the inner face of the cup-like member out of its open end, to allow the member to be easily screwed into or out of the retainer ring to assemble or disassemble the parts.

As mentioned above, the cap, tube and adapter member are preferably designed for use with standard bottles, nipples and retainer rings to provide an extension for feeding a baby at a location spaced from the bottle when necessary. Thus, the bottle is easily convertible for conventional use or use with the extension. Standard nipples typically have a ring of small pin holes 76, as shown in FIG. 2, to allow air to enter the bottle. This would make it difficult to draw liquid out of the bottle by suction in the arrangement shown in FIG. 1, so the adapter member is provided with an annular rib or shield 78 extending from its outer face 80 which would otherwise engage the nipple, the shield being positioned to block air flow through the pin holes 76 when the adapter member is secured to the retainer ring. Thus, the diameter of the annular rib 78 is less than that of the ring of pin holes, so that the rib is located inside the pin holes when the nipple is secured to the adapter member, and blocks or reduces any air flowing into the tube through the pin holes.

This arrangement allows a standard bottle to be easily converted for connection to an extension tube as required, and the extension tube can be disconnected quickly and easily as needed for cleaning or replacement of the various parts of the assembly, or to attach a nipple directly to the bottle for standard feeding, if desired. When the extension tube is attached, as shown in FIG. 1, the bottle can be suitably propped or wedged in a stable location, or secured in place by straps or the like, while the nipple is placed in the baby's mouth for feeding.

Although a preferred embodiment of the invention has been described above by way of example only, it will be understood by those skilled in the field that modifications may be made to the disclosed embodiment without departing from the scope of the invention, which is defined by the appended claims.

I claim:

1. A baby feeding bottle assembly, comprising:

a bottle having an open end, a first, interengageable formation on the open end of the bottle;

a cap having an opening, a second formation on the cap comprising means for releasable mating engagement with said first formation for releasably securing the cap to the bottle;

tubular fluid conducting means extending from the interior of the bottle through the cap opening for conveying fluid out of the bottle, the fluid conducting means including an external flexible tube extending from the cap member outside the bottle; and a nipple assembly for mounting at the free end of the external flexible tube, the assembly including an adapter member having connector means for securing the adapter member to the free end of the tube, a nipple, and a retainer ring for selectively securing the nipple to the adapter member or to the open end of the bottle, the retainer ring and adapter member having co-operable mating third and fourth formations, respectively, for releasable mating engagement to secure the nipple to the adapter member, the third formation being identical to the second formation on the cap and the fourth formation being identical to the first interengageable formation on the open end of the bottle to allow the retainer ring to be releasably secured to the adapter member or bottle, the adapter member having a through bore connecting the tube to the nipple.

2. The assembly as claimed in claim 1, wherein the bottle has a neck at its open end, the neck having external screw threads defining said first formation, the cap having internal screw threads defining said second formation for threaded engagement with the neck of the bottle, the adapter member has an external screw threaded portion of identical size to the neck of the bottle defining said fourth formation, and the retainer ring has a skirt portion with internal screw threads defining said third formation for selectively engaging the threaded portion of the adapter member or the external screw threads on the neck of the bottle.

3. The assembly as claimed in claim 1, wherein the nipple has pin holes and the adapter member includes shield means for preventing air flow through the pin holes into the tube when the nipple assembly is secured to the tube.

4. The assembly as claimed in claim 1, wherein the fluid conducting means includes:

a rigid tubular connecting portion extending through the cap opening, an internal tubular portion secured to the inner end of the rigid tubular portion, and said external flexible tube is secured to the outer end of the connecting portion.

5. The assembly as claimed in claim 1, wherein the cap has integral aligned tubular projections extending from its inner and outer faces, the external tube being secured to the outer tubular projection, and the fluid conducting means including an internal tube secured at one end to the inner tubular projection of the cap.

6. The assembly as claimed in claim 1, wherein the adapter member has finger gripping means for gripping by a user when releasing the adapter member from the retainer ring.

7. The assembly as claimed in claim 1, further including a gasket for fitting inside the cap between the cap and the open upper end of the bottle, the gasket having an opening aligned with the opening in the cap through which the fluid conducting means projects.

8. The assembly as claimed in claim 7, wherein the gasket has at least one pin hole for allowing air to enter the bottle.

9. The assembly as claimed in claim 1, wherein:

the retainer ring comprises a cup-shaped member having an end face with a central opening and a cylindrical skirt having internal screw threads defining said third formation, the nipple having a central portion for projecting through the central opening and a rim for retaining inside the end face;

the adapter member comprises a corresponding cup-like member having an end face and a cylindrical skirt projecting from the inner side of said end face, the outer side of said end face comprising means for engagement in the retainer ring to clamp the rim of the nipple between the adapter member end face and end face of the retainer ring, the adapter member skirt having external screw threads defining said fourth formation for releasable engagement with the internal screw threads on the retainer ring; and the connector means comprising a central spigot projecting from the inner side of the end face of the adapter member in the direction of the open end of the skirt for securing to the end of the tube.

10. The assembly as claimed in claim 9, wherein the nipple has a series of pin holes extending in a ring around its rim, and the adapter member has an annular rib projecting from its end face defining said means for engagement with the rim of the nipple at a location inside the ring of pin holes.

11. The assembly as claimed in claim 9, wherein the adapter member has finger gripping means for gripping by a user when releasing the adapter member from the retainer ring, the gripping means comprising a pair of finger grip members projecting outwardly from the inner side of said end face of said adapter member out of the open end of said skirt on diametrically opposed sides of said spigot.

12. A baby feeding bottle assembly, comprising:

a bottle having a neck portion with an open end, the neck portion having external screw threads;

a cap having an end face with an opening and an outwardly projecting cylindrical skirt having internal screw threads for releasable threaded engagement with the external screw threads on said bottle;

tubular fluid conveying means extending from the interior of the bottle through the cap opening for conveying fluid out of the bottle, the fluid conveying means including an external flexible tube portion extending outwardly from the cap;

a nipple having an annular retaining rim;

a retainer ring for releasably mounting the nipple on a bottle, the ring comprising a cup-shaped member having an end face with a central opening for receiving the nipple, and a cylindrical skirt extending from the end face having internal screw threads for selective threaded engagement with the external screw threads on the bottle; and an adapter member comprising a corresponding cup-like member for selectively securing the retainer ring and nipple to the end of said external flexible tube portion, said adapter member having an end face and a cylindrical skirt extending from the inner side of the end face having external screw threads of identical dimensions to the screw threads on the bottle for selective mating engagement with said retainer ring, the outer side of said end face comprising means for engagement in the retainer ring to clamp the rim of the nipple against a corresponding inner face of the nipple retainer ring, said member including securing means projecting from the inner side of said end face for securing said member to the end of said external tube portion and a passageway for connecting said nipple to said tube portion.

13. A baby bottle extension assembly for use with a baby bottle having an open end, a nipple, and a retainer ring for securing the nipple to the open end of the bottle, the extension assembly comprising:

a cap releasably mountable on the open end of a baby feeding bottle, the cap having an opening;

tubular fluid conveying means extending through the cap for conveying fluid from the interior of the bottle to a position spaced from the bottle when the cap is mounted on the open end of the bottle; and an adapter member for releasably securing a nipple to one, external end of the fluid conveying means, the adapter member comprising a cup-like member having a flat end face and a cylindrical skirt portion projecting from the inner side of said end face, the outer side of said end face comprising means for clamping a nipple against a corresponding inner face of a nipple retainer ring, said skirt portion having external securing means of predetermined form and dimensions identical to those on a baby bottle for securing a nipple retainer ring to the bottle, the securing means being mateable with corresponding interengageable securing means on the corresponding internal surface of a nipple retainer ring for releasably securing the adapter member to a retainer ring, with a rim of a nipple clamped between the outer side of said end face of the adapter member and the inner end face of a retainer ring, and a through bore for connecting the fluid conveying means to the nipple;

the adapter member having connector means projecting from the inner side of said end face in the direction of the skirt for connecting said adapter member through bore to said external end of said fluid conveying means.

14. The assembly as claimed in claim 13, wherein the adapter member has external screw threads defining said securing means for mating engagement with corresponding internal screw threads on a nipple retainer ring defining said interengageable securing means.

15. The assembly as claimed in claim 13, wherein the outer side of said end face of said adapter member has a projecting annular rib for engaging the nipple at a location spaced inwardly of any pin holes on the nipple rim.

* * * * *